US007194990B2

(12) United States Patent
Sun

(10) Patent No.: US 7,194,990 B2
(45) Date of Patent: Mar. 27, 2007

(54) ELECTRO-HYDRAULIC ENGINE VALVE ACTUATION

(75) Inventor: Zongxuan Sun, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 40 days.

(21) Appl. No.: 11/206,601

(22) Filed: Aug. 18, 2005

(65) Prior Publication Data

US 2006/0254543 A1 Nov. 16, 2006

Related U.S. Application Data

(60) Provisional application No. 60/679,322, filed on May 10, 2005.

(51) Int. Cl.
*F01L 9/02* (2006.01)

(52) U.S. Cl. ..... 123/90.12; 123/90.15; 251/54; 251/30.01; 251/57; 91/47; 91/51; 91/403; 91/404

(58) Field of Classification Search ..... 123/90.12; 91/47, 51, 403, 404; 251/54, 57
See application file for complete search history.

(56) References Cited

U.S. PATENT DOCUMENTS 6,386,346 B1 * 5/2002 Kim et al. ..... 188/359
6,966,285 B1 * 11/2005 Sun ..... 123/90.12
7,040,266 B1 * 5/2006 Sun et al. ..... 123/90.16

* cited by examiner

*Primary Examiner*—Thomas Denion
*Assistant Examiner*—Kyle M. Riddle
(74) *Attorney, Agent, or Firm*—Kathryn A. Marra

(57) ABSTRACT

Hydraulic actuator as an element of a system for controlling an engine valve is presented. The actuator includes a fluidic actuation chamber, defined by an actuation piston that increases chamber volume as the actuation piston is urged away from a neutral. Chamber includes a high pressure fluid inlet and a fluid outlet. A fluidic actuator control chamber, defined by a control piston connected to the actuation piston that increases chamber volume as the actuation piston is urged away from neutral. A control fluid outlet is connected to a fluid control spool valve. The fluid outlet of the actuation chamber is fluidly connected to an inlet of the control valve. There is a valve actuation plunger operably connected to the actuation piston, and a drain outlet to maintain a fluidic backpressure to the actuator control chamber.

17 Claims, 1 Drawing Sheet

ELECTRO-HYDRAULIC ENGINE VALVE ACTUATION

CROSS-REFERENCE TO RELATED APPLICATIONS

This application claims priority from U.S. Provisional Application No. 60/679,322, filed May 10, 2005, entitled ELECTRO-HYDRAULIC ENGINE VALVE ACTUATION.

TECHNICAL FIELD

The present invention is related to internal combustion engine valvetrains. More particularly, the invention is concerned with engine valve actuation, especially electro-hydraulically actuated fully flexible valvetrains.

BACKGROUND OF THE INVENTION

A valvetrain having fully flexible valve actuation is desirable in an internal combustion engine. The ability to control duration, phase, and lift of each engine valve provides an engine designer with tools to achieve benefits measured in emissions, engine performance and fuel economy not otherwise attainable with conventional valvetrains. While a certain level of flexibility is achievable with cam-based valve actuation systems, e.g., systems employing camshaft phasers, multi-profile cams or lifter deactivation devices, these systems are not able to provide a fully flexible valve control system having a broad range of authority to control valve opening time, duration, and magnitude of lift from fully closed to fully open.

Practitioners have investigated various systems to achieve fully-flexible valve actuation capability, including electromagnetic valve actuation systems. Such systems are camless, but have not been shown to provide variable lift control over full range of valve lift, from fully open to fully closed. Electro-hydraulic valve actuation systems have been proposed and developed for application to internal combustion engines and are capable of providing timing, phasing and fully variable valve lift. Presently known electro-hydraulic valvetrain systems are undesirably large and costly. Furthermore, energy consumption and controllability continue to present challenges to production implementation of such systems.

Therefore, there is a need for an electro-hydraulic valve actuation system capable of providing full-range control of engine valve open duration, engine valve open phase relative to the crankshaft, and magnitude of engine valve lift.

SUMMARY OF THE INVENTION

The present invention improves system controllability and energy consumption. In accordance with the present invention, a hydraulic actuator for an internal combustion engine valve is presented. The actuator includes a fluidic actuation chamber, defined in part by an actuation piston and characterized by increasing chamber volume as the actuation piston is urged away from a neutral position. The chamber includes a high pressure fluid inlet and a fluid outlet. There is a fluidic actuator control chamber, defined in part by a control piston operably connected to the actuation piston, and characterized by increasing chamber volume as the actuation piston is urged away from the neutral position. The actuator control chamber includes a control fluid outlet. There is a fluid control valve, comprising a spool valve having a fluidic control chamber fluidly connected to the control fluid outlet of the actuator control chamber. The fluid outlet of the actuation chamber is fluidly connected to an inlet of the control valve. There is a valve actuation plunger operably connected to the actuation piston.

Another aspect of the invention comprises the actuator control chamber having a drain outlet, operable to maintain a fluidic backpressure to the actuator control chamber.

Another aspect of the invention comprises the control piston having a piston head operable to slideably linearly move within the actuator control chamber as the actuation piston is urged away from the neutral position, and, operable to control fluid flow between the actuator control chamber and the drain outlet.

Another aspect of the invention is the valve actuation plunger operably coupled to a stem of an engine valve.

Another aspect of the invention is the neutral position of the actuation piston defined by urging of a spring operable to maintain the engine valve in a normally closed position, wherein the actuation piston is urged away from the neutral position by introduction of pressurized fluid at the high pressure fluid inlet, thus urging the engine valve open.

Another aspect of the invention is the control valve having the spool valve with a first state, being the control valve open between the control valve inlet and a drain fluidly connected to the control valve, and a second state, being the control valve closed between the control valve inlet and the drain fluidly connected to the control valve.

Another aspect of the invention is a hydraulic actuation system, including a high pressure fluid control circuit, consisting of a high pressure fluid pump, a first fluid control valve, a hydraulic valve actuator, and a second fluid control valve. The hydraulic valve actuator has been described hereinabove.

These and other aspects of the invention will become apparent to those skilled in the art upon reading and understanding the following detailed description of the embodiments.

BRIEF DESCRIPTION OF THE DRAWINGS

The invention may take physical form in certain parts and arrangement of parts, the preferred embodiment of which will be described in detail and illustrated in the accompanying drawings which form a part hereof, and wherein.

DETAILED DESCRIPTION OF AN EMBODIMENT OF THE INVENTION

An exemplary hydraulic engine valve actuator 10 and valve actuation circuit is described hereinbelow, and is intended for application with a fully flexible electro-hydraulic valve actuation system being implemented on a conventionally-constructed multi-cylinder internal combustion engine. The exemplary engine comprises an engine block, a cylinder head 44, a crankshaft, and has a plurality of cylinders formed in the engine block. Each cylinder contains a piston operable to move linearly therewithin, and mechanically operably connected to the crankshaft via a piston rod. The crankshaft is mounted on main bearings attached to the engine block. A combustion chamber is formed in each cylinder between the top of each piston and the cylinder head. The crankshaft rotates in the main bearings, in response to linear force applied thereto by the piston rods, as a result of combustion events in each combustion chamber.

The cylinder head 44 preferably comprises a conventional cast-metal device providing mounting structure for the engine intake and exhaust valves. The cylinder head is modified to effectively mount and accommodate a plurality of the valve actuators 10. There is at least one intake valve and one exhaust valve corresponding to each cylinder and combustion chamber, and one valve actuator 10 for each of the intake valves and exhaust valves. Each intake valve is operable to open and allow inflow of air and fuel to the corresponding combustion chamber. Each exhaust valve is operable to open and allow flow of products of combustion out of the corresponding combustion chamber to an exhaust system.

Figure 1:
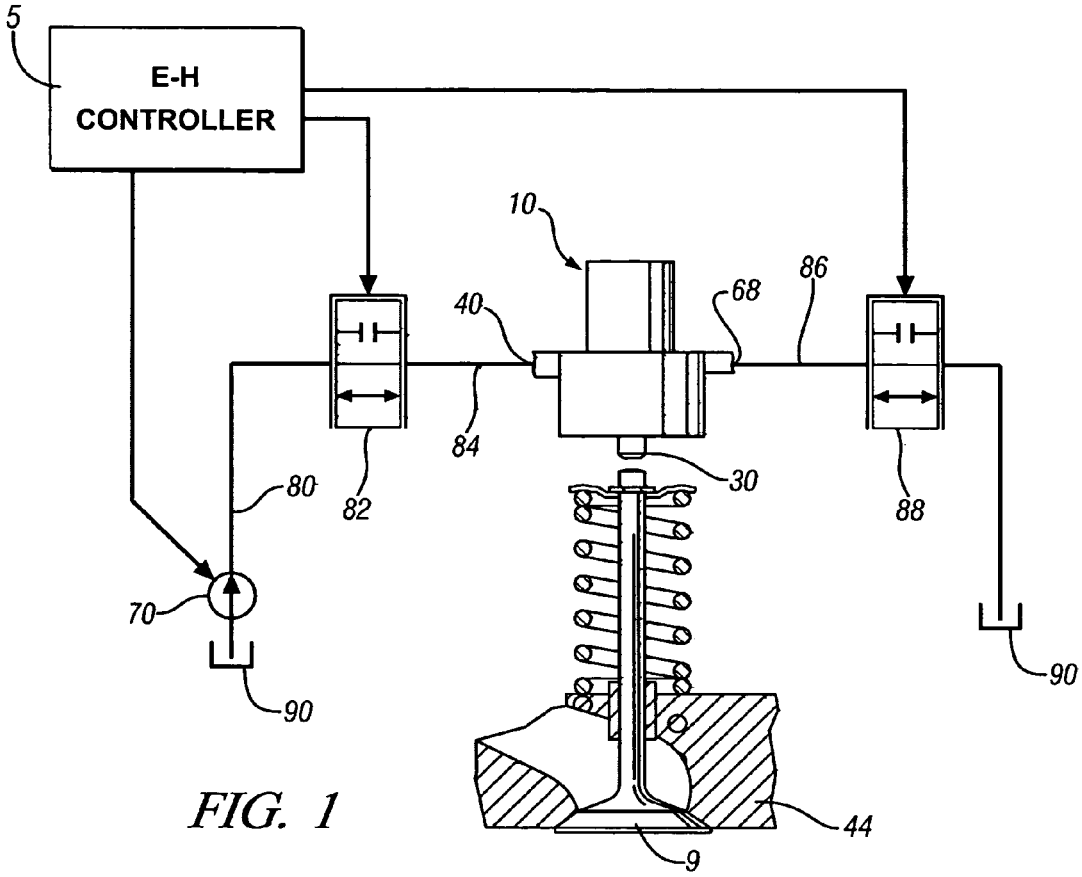
FIG. 1 is a schematic diagram of a hydraulic circuit for controlling a hydraulic engine valve actuator, in accordance with the present invention; and, FIG. 2 is a schematic drawing of a hydraulic engine valve actuator, in accordance with the present invention.

Referring now to the drawings, wherein the showings are for the purpose of illustrating the invention only and not for the purpose of limiting the same, FIG. 1 shows a schematic diagram of an exemplary fully flexible electro-hydraulic valve actuation system, including the engine valve actuator 10, which has been constructed in accordance with an embodiment of the present invention. The exemplary system is preferably operable to control magnitude of valve lift, L, duration of valve opening, D, and timing of valve opening, θ, of each of the intake valves and exhaust valves, in response to control signals from a control device, and according to predetermined control schemes. The control device is preferably a subsystem of an overall engine control scheme, executed in an engine controller 5, to ongoingly control operation of the engine. The engine controller 5 is preferably operable to monitor input from various engine sensors and operator inputs, and actuate various control devices in response thereto, using on-board control schemes in the form of algorithms and calibrations. Specifically included in the valve control scheme is an ability to monitor engine operation, operator input, and ambient conditions, and determine optimal valve opening profiles, in terms of magnitude of valve lift, L, duration of valve opening, D, and timing of valve opening, θ, relative to crankshaft angular position, to optimize engine operation.

The engine controller is preferably an electronic control module comprising a central processing unit signally electrically connected to volatile and non-volatile memory devices via data buses. The controller is operably attached to sensing devices and other output devices to ongoingly monitor and control engine operation. The output devices preferably include subsystems necessary for proper control and operation of the engine, including, by way of example, a fuel injection system, a spark-ignition system (when a spark-ignition engine is used), an exhaust gas recirculation system, and an evaporative control system. The engine sensing devices include devices operable to monitor engine operation, external conditions, and operator demand, and are typically signally attached to the controller 5. Control algorithms are typically executed during preset loop cycles, with each control algorithm being executed at least once each loop cycle. Loop cycles are typically executed each 3, 6, 15, 25 and 100 milliseconds during engine operation. Alternatively, control algorithms may be cyclically executed, and driven by occurrence of an event. An exemplary cyclical event comprises executing a control algorithm each engine cycle, or each engine revolution. A control algorithm for determining a position at which to control each engine valve is typically executed each engine cycle. Use of the controller 5 to control operation various aspects of the internal combustion engine is well known to one skilled in the art.

Referring again to FIG. 1, the exemplary fully flexible electro-hydraulic valve actuation system preferably comprises a closed, high-pressure fluid circuit associated with each valve actuator 10, and operably connected to a controller 5. The exemplary closed, high-pressure fluid circuit comprises a high pressure hydraulic pump 70 fluidly connected via conduit 80 to a first flow control valve 82, which is fluidly connected via conduit 84 to an inlet 40 of a hydraulic valve actuator 10. A fluid outlet 68 of valve actuator 10 is fluidly connected via conduit 86 to a second flow control valve 88, which vents to a sump 90. The hydraulic pump 70 and the first and second fluid flow control valves 82, 88 are operably connected to the controller 5. The first and second fluid flow control valves 82, 88 each preferably comprises a two-state spool fluid control valve designed for use in a high-pressure fluid control system. The first state of each spool fluid control valve 82, 88 comprises an open-flow condition, and the second state comprises a fluidly sealed, no-flow condition. The valve actuator 10 is physically mounted on the cylinder head 44 at a mount so a distal end of a plunger 30 of the valve actuator 10 is in physical contact with an end of a stem of engine valve 9, and operable to exert opening force thereon. Valve 9 is preferably a conventional engine valve, configured to have a spring disposed to provide a closing force. The engine valve 9 is normally closed, and the valve actuator 10 must generate sufficient force through plunger 30 to overcome the spring closing force to open the valve 9. Typically, opening the valve 9 comprises moving the stem and valve linearly eight to thirteen millimeters. The engine valve 9 in a normally closed position defines a neutral position for the valve actuator 10 when assembled thereto. The hydraulic circuit described hereinabove preferably uses engine oil as hydraulic fluid. However other type of fluid can also be used with this system. The high pressure hydraulic pump 70 is sized to provide sufficient hydraulic pressure to overcome closing force of an engine valve spring coupled with pumping force generated in the combustion chamber which acts upon the inside of the cylinder head and valve. This is typically in the range of seven to twenty one MPa, at high engine speed conditions. A skilled practitioner is able to select components necessary to accomplish the tasks of the system described herein, including selecting a hydraulic pump having requisite pressure and flow characteristics.

Figure 2:
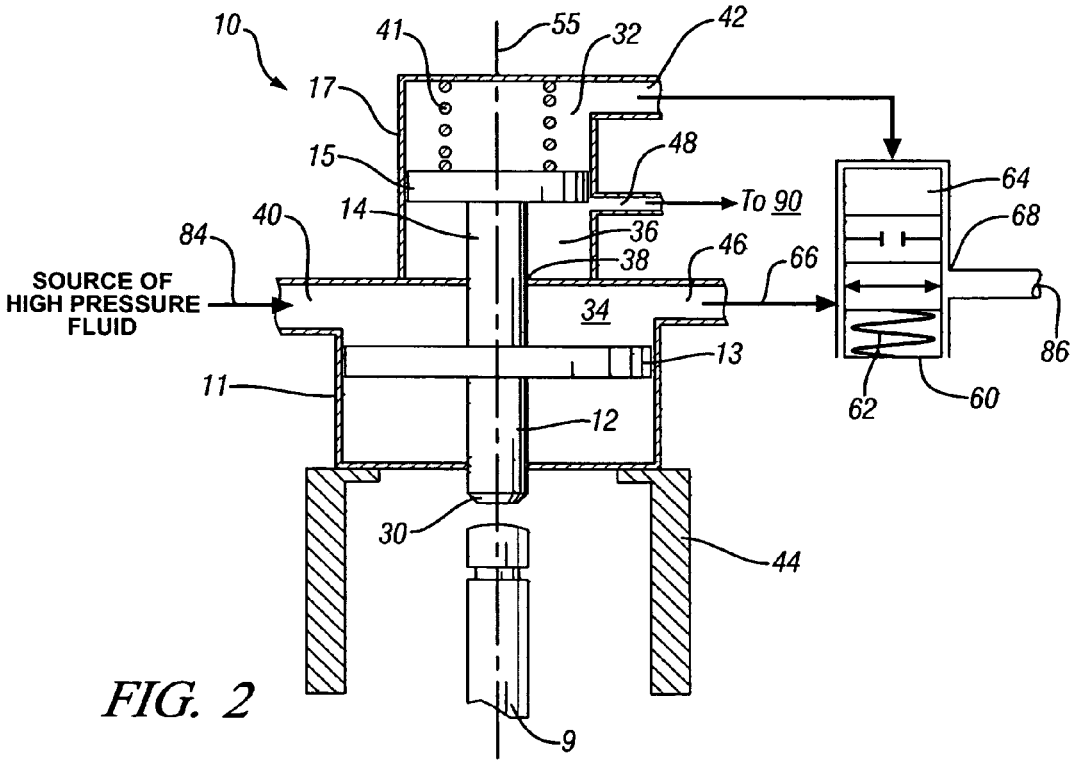

Referring now to FIG. 2 a schematic diagram of valve actuator 10, an element of the circuit described with reference to FIG. 1, is shown. Each valve actuator 10 is mounted on the cylinder head 44 in a manner suitable for plunger 30 of the actuator 10 to physically interact with the engine valve 9, as previously described. The plunger 30 and the engine valve 9 are co-linear along an axis 55 to maximize transmission of opening force to the valve stem, in this embodiment. The actuator 10 comprises actuation device 11, control device 17, and, a fluid control valve 60. The actuation device 11 comprises a fluidic actuation chamber 34 having an actuation piston 12. The control device 17 comprises a fluidic actuator control chamber 32 having a control piston 14. The actuation piston 12, the control piston 14, and the plunger 30 are shown in this embodiment to be a unitary piece. It is understood that there is no requirement for an embodiment to have a unitary piece for the combination of the actuation piston 12, the control piston 14, and the plunger 30.

The actuation device 11 comprises a cylindrically-shaped metal body in which actuation chamber 34 is formed, and which preferably comprises a high-pressure fluid chamber having a high pressure fluid inlet 40 and a fluid outlet 46.

The exemplary cylindrically-shaped actuation chamber 34 has a centerline co-linear with the axis 55. A lower end of the actuation chamber 34 includes a coaxial circular opening having a guide and a high pressure fluid seal (not shown), through which the plunger 30 passes. A top end of the actuation chamber 34 includes a coaxial circular opening having a guide and a high pressure fluid seal, and through which the control piston 14 passes to interact with the actuation piston 12. The actuation piston 12 is substantially contained within the chamber 34, having a piston head 13 which fits sealingly against inside walls of the actuation chamber 34. The actuation chamber 34 is characterized by increasing chamber volume as the piston head 13 is urged away from neutral position by flow of pressurized fluid through the high pressure fluid inlet 40 when fluid flow through the fluid outlet 46 is closed.

The control device 17 comprises a cylindrically-shaped metal body in which control chamber 32 and lower chamber 36 are formed, and is preferably attached to the actuation chamber 34. The control chamber 32 and lower chamber 36 are separated by and defined by piston head 15 of control piston 14. The control device 17 has a control fluidic outlet 42 and a drain outlet 48. The cylindrically-shaped control chamber 32 and lower chamber 36 have a common centerline co-linear with the axis 55. A lower end of the chamber 36 includes the coaxial circular opening with guide and seal, through which the control piston 14 passes to interact with the actuation piston 12. The piston head 15 fits sealingly against inside walls of the control chamber 32 and lower chamber 36. The piston head 15 is operable to slidably linearly move within the control chamber 32 and lower chamber 36. The control chamber 32 is characterized by increasing chamber volume as the piston head 15 is urged away from neutral position by flow of pressurized fluid into the actuation chamber 34 through the high pressure fluid inlet 40 when the fluid outlet 46 of the actuation chamber 34 is closed, thus causing the actuation piston 12, the plunger 30, and the control piston 14 to move linearly along axis 55. The drain outlet 48 is preferably located in control device 17 along a portion of the chamber wall over which the piston head 15 passes during normal movement of the piston 14 in response to variations in fluid pressure levels. The drain outlet 48 provides an opening for flow of fluids to fluid sump 90. The piston head 15 and drain outlet 48 are preferably designed in a manner that the piston head 15 is operable to shut-off flow to the drain outlet 48 when the piston head 15 slideably moves past the drain outlet 48. The drain outlet 48 and fluid sump 90 are preferably designed to provide a level of fluid backpressure to the control chamber 32 when the drain outlet 48 is open for flow to the fluid sump 90.

The fluid control valve 60 preferably comprises a two-state spool fluid control valve designed for use in a high-pressure fluid control system. The first state of each spool fluid control valve comprises an open-flow condition, and the second state comprises a sealed, no-flow condition. The control valve 60 has a fluidic control chamber 64 fluidly connected to the control fluid outlet 42 of the actuator control chamber 32. There is a bias force generator, in form of a spring 62, that acts on the spool portion of the valve 60 in opposition to fluid pressure generated in the fluidic control chamber 64. In the first state, comprising the open-flow condition, pressurized fluid flows from the outlet 46 of the actuator chamber 34 to inlet 66 of the control valve 60, through the open valve, to valve outlet 68, and to conduit 86. In closed position, the fluidic pressure in the fluidic control chamber 64 moves the spool downward, thus prohibiting flow of fluid therethrough and creating a fluidic seal at inlet 66.

Operation of the present invention is now described, by way of example, with reference to the accompanying drawings, in which FIGS. 1 and 2 comprise schematic illustrations of the fully flexible electro-hydraulic valve actuation system, in accordance with the present invention.

In a deactivated or neutral state, when the engine valve 9 is in neutral position, i.e. closed, the first and second fluid flow control valves 82, 88 are controlled to closed positions, allowing no flow through the hydraulic circuit.

The process to open engine valve 9 comprises the controller 5 opening flow control valve 82 and keeping valve 88 closed, with pump 70 operating. The control valve 60 is initially closed, i.e. no flow. The control chamber drain outlet 48 is normally initially closed. High pressure hydraulic fluid flows through channel 84 to inlet 40 of the actuator 10, and into actuation chamber 34. The pressurized fluid creates a force upon the actuation piston 12, which propagates through plunger 30 and acts upon the stem of the engine valve 9, to exert opening force. When the hydraulic pump 70 exerts sufficient pressure on the actuation piston 12 to overcome closing spring force of the engine valve 9, the engine valve 9 is opened. The movement of the actuation piston 12 causes a corresponding movement in the control piston 14, thus increasing volume of control chamber 32. Control spring 62 of control valve 60 exerts a pressure force upon the moveable spool of fluid control valve 60, causing it to move within the valve. This movement exerts force upon valve control chamber 64, which in turn forces fluid out of chamber 64 through control inlet 42 into actuator control chamber 32. At a point-certain, where conduits 66 and 86 are fluidic connected, the spool of fluid control valve 60 reaches a mechanical stop-point, and the valve 60 reaches or attains the open state. When valve 60 is in the open state, pressurized fluid flows out of actuation chamber 34, through control valve 60, to flow conduit 86. The movement of actuation piston 12 and corresponding movement of control piston 14 causes the head 15 of control piston 14 to move within chamber 32, and thus opens drain outlet 48. Opening of drain outlet 48 allows fluid flow out of chamber 32 to the drain and sump 90, with a fluidic backpressure from the drain exerting a small amount of hydraulic pressure.

Movement of the engine valve 9 is controlled to desired lift, L, by control of inlet valve 82. Inlet valve 82 is opened until the actuation chamber has reached a desired hydraulic pressure corresponding to desired lift. The inlet valve 82 is closed when the desired pressure, corresponding to desired engine lift, L, has been reached. When the inlet valve 82 is closed, pressure is maintained in the actuation chamber 34, and the engine valve 9 is held at the desired lift, L.

The engine valve 9 is subsequently closed by the action of opening valve 88, releasing the hydraulic pressure in the actuation chamber 34, thus permitting the action of the spring of the engine valve 9 to close the valve and overcome the hydraulic pressure. The spring force and corresponding movement of the plunger 30 move the actuation piston 12, and the control piston 14. Movement of the control piston 14 moves the piston head 15, eventually closing flow to the drain outlet 48. From this point forward through complete closing of the engine valve 9, movement of the control piston 14 generates a fluidic pressure in chamber 32 which is transmitted to valve control chamber 64. When this fluidic pressure is sufficient to overcome the force exerted by control spring 62, the spool in the valve 60 moves downward. The engine valve 9 will continue to move upward while the spool of the control valve 60 moving downward until it closes off fluid flow through the valve 60. Then the engine valve 9 comes to a natural stop at the valve seat.

The actuator 10 preferably includes a mechanism to provide lash adjustment, in this embodiment shown as a compression spring 41, which acts to keep the actuation piston 14 and plunger 30 physically against the engine valve stem, to accommodate dimensional changes of the valve stem caused by thermal changes in the engine and valves 9.

In an alternate embodiment, the actuator includes a position sensor (not shown) mechanized to provide engine valve 9 position feedback to the controller 5, for improved control and actuation.

The present invention provides enhanced controllability by utilizing the internal feedback mechanism between the engine valve 9 and the control valve 60. The control chamber 64 and actuator control chamber 32 and channels 42 and 48 are preferably sized to optimize the feedback mechanism, thus enabling better performance less energy consumption, plus providing soft valve closing to reduce noise and wear. The present invention employs less hardware content, which corresponds to lower cost, smaller size and less mass. The present invention relies on relatively simple external control, comprising the external on/off flow valves 82, 88, which provide timing control, whereas the self-regulation of the engine valve is accomplished automatically by the internal feedback described hereinabove.

The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. Hydraulic actuator for an internal combustion engine valve, comprising:

a fluidic actuation chamber, defined in part by an actuation piston and characterized by increasing chamber volume as the actuation piston is urged away from a neutral position, and, having a high pressure fluid inlet, and, a fluid outlet;

a fluidic actuator control chamber, defined in part by a control piston operably connected to the actuation piston, and characterized by increasing chamber volume as the actuation piston is urged away from the neutral position, and, having a control fluid outlet;

a fluid control valve, comprising a spool valve having a fluidic control chamber fluidly connected to the control fluid outlet of the fluidic actuator control chamber;

the fluid outlet of the fluidic actuation chamber fluidly connected to an inlet of the control valve; and, a valve actuation plunger, operably connected to the actuation piston.

2. The hydraulic actuator of claim 1, wherein the actuator control chamber further comprises a drain outlet.

3. The hydraulic actuator of claim 2, wherein the control piston comprises a piston head, operable to slideably linearly move within the actuator control chamber as the actuation piston is urged away from the neutral position, and, operable to control fluid flow between the actuator control chamber and the drain outlet.

4. The hydraulic actuator of claim 3, wherein the drain outlet is operable to maintain a fluidic backpressure to the actuator control chamber.

5. The hydraulic actuator of claim 1, wherein the valve actuation plunger is operably coupled to a stem of an engine valve.

6. The hydraulic actuator of claim 5, wherein the neutral position of the actuation piston is defined by urging of a spring operable to maintain the engine valve in a normally closed position.

7. The hydraulic actuator of claim 6, wherein the actuation piston is urged away from the neutral position by introduction of pressurized fluid at the high pressure fluid inlet.

8. The hydraulic actuator of claim 7, wherein the engine valve is urged open when the actuation piston is urged away from the neutral position by the introduction of pressurized fluid at the high pressure fluid inlet.

9. The hydraulic actuator of claim 1, wherein the fluid control valve further comprises the spool valve having a first state, and, a second state; the first state comprising: the control valve open between the control valve inlet and a drain fluidly connected to the control valve; the second state comprising the control valve closed between the control valve inlet and the drain fluidly connected to the control valve.

10. The hydraulic actuator of claim 9, wherein the control valve is open when the control valve is in a neutral position.

11. The hydraulic actuator of claim 9, wherein the drain is operable to maintain a fluidic backpressure.

12. The hydraulic actuator of claim 1, wherein the actuation piston is operable to slidably linearly move within the actuation chamber along an axis.

13. The hydraulic actuator of claim 12, wherein the valve actuation plunger is located co-linearly to the actuation piston along the axis.

14. Hydraulic actuation system for an internal combustion engine valve, comprising:

a high pressure fluid control circuit, comprising: a high pressure fluid pump fluidly connected to a first fluid control valve fluidly connected to a hydraulic valve actuator fluidly connected to a second fluid control valve; the hydraulic valve actuator comprising:

a) a fluidic actuation chamber, defined in part by an actuation piston, characterized by increasing chamber volume as the actuation piston is urged away from a neutral position, and, having a high pressure fluid inlet and a fluid outlet;

b) a fluidic actuator control chamber, defined in part by a control piston operably connected to the actuation piston, and, characterized by increasing chamber volume as the actuation piston is urged away from the neutral position, and, having a control fluid outlet;

c) a fluid control valve, comprising a spool valve having a fluidic control chamber fluidly connected to the control fluid outlet of the fluidic actuator control chamber;

d) the fluid outlet of the actuation chamber fluidly connected to an inlet of the control valve; and, e) a valve actuation plunger, operably connected to the actuation piston.

15. The hydraulic actuation system of claim 14, further comprising: a controller operable to control the high pressure fluid pump, the first fluid control valve, and the second fluid control valve.

16. The hydraulic actuation system of claim 15, wherein a drain outlet of the fluid control valve of the hydraulic valve actuator is fluidly connected to an inlet port of the second control valve.

17. Electro-hydraulic valve actuation mechanism for an internal combustion engine, comprising:

a) a valve assembly including a valve, a valve seat, a valve stem, a spring effective to urge the valve toward the valve seat, a main fluid chamber defined in part by a piston coupled to the valve stem and characterized by increasing chamber volume as the valve moves away from the valve seat, and a secondary fluid chamber defined in part by the piston and characterized by increasing chamber volume as the valve moves away from the valve seat;

b) a high pressure fluid line selectively coupled to the main fluid chamber;

c) a spool valve including first and second ports, a spool, a spring effective to urge the spool toward a first position whereat the first and second ports are fluidically coupled, a valve fluid chamber defined in part by the spool wherein fluid pressure therein urges the spool toward a second position whereat the first and second ports are fluidically de-coupled, the valve fluid chamber being fluidically coupled to the secondary fluid chamber and the first port being fluidically coupled to the main fluid chamber;

d) a first low pressure fluid line selectively coupled to the second port; and, e) a second low pressure fluid line fluidically de-coupled from the secondary fluid chamber when the valve is in a first region of operation from a fully closed position to a predetermined partially open position, and fluidically coupled to the secondary fluid chamber when the valve is in a second region of operation from the predetermined partially open position to a fully open position.

* * * * *